US012497746B2

(12) United States Patent
Zelkowski et al.

(10) Patent No.: US 12,497,746 B2
(45) Date of Patent: Dec. 16, 2025

(54) LATERALLY EXPANDED CAPACITY-ENHANCED PILES AND ANCHORS

(71) Applicant: Arrowhead Center, Inc., Las Cruces, NM (US)

(72) Inventors: Peter Zelkowski, Roswell, NM (US); Paola Bandini Badiello, Las Cruces, NM (US); Craig M. Newtson, Las Cruces, NM (US)

(73) Assignee: Arrowhead Center, Inc., Las Cruces, NM (US)

( * ) Notice: Subject to any disclaimer, the term of this patent is extended or adjusted under 35 U.S.C. 154(b) by 0 days.

(21) Appl. No.: 18/768,659

(22) Filed: Jul. 10, 2024

(65) Prior Publication Data

US 2025/0052026 A1 Feb. 13, 2025

Related U.S. Application Data

(60) Provisional application No. 63/525,906, filed on Jul. 10, 2023.

(51) Int. Cl.
*E02D 5/80* (2006.01)
*E02D 5/22* (2006.01)
(Continued)

(52) U.S. Cl.
CPC ..... *E02D 5/805* (2013.01); *E02D 5/22* (2013.01); *E02D 5/385* (2013.01); *E02D 5/44* (2013.01);
(Continued)

(58) Field of Classification Search
CPC .... E02D 5/22; E02D 5/74; E02D 5/80; E02D 5/505; E02D 5/44; E02D 5/385; E02D 27/50; E02D 2600/0029; E02D 2600/30
See application file for complete search history.

(56) References Cited

U.S. PATENT DOCUMENTS 1,807,488 A 5/1931 Michalicek
3,012,644 A 12/1961 Bush
(Continued)

FOREIGN PATENT DOCUMENTS

AU 2022283196 A1 12/2023
CN 212927781 U 4/2021
(Continued)

OTHER PUBLICATIONS

Age Developments, "Inflatable Packers", https://www.agedevelopments.com.au/home/inflatable-packers/.
(Continued)

*Primary Examiner* — Kyle Armstrong
(74) *Attorney, Agent, or Firm* — Peacock Law P.C.; Justin R. Jackson; Daniel J. Berenger-Russell

(57) ABSTRACT

Method and apparatus for enhancing capacity of piles and/or anchors, which can include any type of piles and/or anchors, including but not limited to micropiles and soil nail, by disposing a tube or casing into the earth and then laterally expanding at least a portion of the casing, in plastic deformation, using an expansion member such that an enlarged area is formed in the casing. The casing can then optionally be left in place and filled with a filler material and/or can optionally be forcibly pulled out of the ground, thus compacting and thereby densifying the surrounding soil, and the thusly formed enlarged hole can be filled with a filler material and used as an anchor and/or pile. Optionally, in one embodiment, existing piles and/or anchors can be reused by lowering an expansion member into them and creating one or more laterally expanded areas.

26 Claims, 13 Drawing Sheets

(51) Int. Cl.

| | |
|---|---|
| ***E02D 5/38*** | (2006.01) |
| ***E02D 5/44*** | (2006.01) |
| ***E02D 5/64*** | (2006.01) |
| ***E02D 5/74*** | (2006.01) |
| ***E02D 27/50*** | (2006.01) |

(52) U.S. Cl.

CPC ..... *E02D 5/64* (2013.01); *E02D 5/74* (2013.01); *E02D 27/50* (2013.01); *E02D 5/80* (2013.01); *E02D 2300/0029* (2013.01); *E02D 2600/30* (2013.01)

(56) References Cited

U.S. PATENT DOCUMENTS

| | | | | |
|---|---|---|---|---|
| 3,214,918 | A | 11/1965 | Binnings | |
| 3,324,666 | A | 6/1967 | Lee | |
| 3,512,319 | A | 5/1970 | Piacentino | |
| 4,160,613 | A | 7/1979 | Stanwick | |
| 4,547,106 | A | 10/1985 | Lipsker | |
| 4,768,900 | A | 9/1988 | Burland | |
| 5,992,103 | A | 11/1999 | Norman et al. | |
| 6,210,077 | B1 | 4/2001 | Kondo | |
| 6,401,407 | B1 | 6/2002 | Humphrey | |
| 6,793,444 | B2 | 9/2004 | Kondo et al. | |
| 9,540,783 | B2 | 1/2017 | Lymberis | |
| 9,567,821 | B2 | 2/2017 | Bramwell | |
| 11,002,098 | B2 | 5/2021 | Andersen | |
| 11,142,878 | B1 | 10/2021 | Aleali et al. | |
| 11,603,638 | B1 | 3/2023 | Aleali et al. | |
| 2004/0091323 | A1 | 5/2004 | Simmons et al. | |
| 2015/0204106 | A1 * | 7/2015 | Hedley | E04H 17/26 52/843 |
| 2015/0252546 | A1 | 9/2015 | Berger | |

FOREIGN PATENT DOCUMENTS

| | | | | | |
|---|---|---|---|---|---|
| EP | 0820550 | B1 | | 10/2001 | |
| GB | 2401631 | A | * | 11/2004 | E21B 17/08 |
| KR | 20020072521 | A | | 9/2002 | |
| KR | 20160102817 | A | * | 8/2016 | |
| KR | 20170137485 | A | | 12/2017 | |
| KR | 102224524 | B1 | | 3/2021 | |
| KR | 20210047205 | A | * | 4/2021 | |
| RU | 2778911 | C1 | | 8/2022 | |
| WO | 9106713 | A1 | | 5/1991 | |
| WO | WO-2008135539 | A1 | * | 11/2008 | E21B 43/105 |
| WO | 2017001506 | A1 | | 1/2017 | |

OTHER PUBLICATIONS

Aleali, Seyed Ali, et al., "Multifaceted Bioinspiration for Improving the Shaft Resistance of Deep Foundations", J Bionic Eng, vol. 17, 2020, 1059-1074.

Kim, Junghoon , et al., "Development of Expanded Steel Pipe Pile to Enhance Bearing Capacity", Sustainability, vol. 14, Issue 5, 2022, 1-10.

Winter, V, Amos G., et al., "Identification and Evaluation of the Atlantic Razor Clam (*Ensis directus*) for Biologically Inspired Subsea Burrowing Systems", Integrative and Comparative Biology, vol. 51, No. 1, Oxford University Press, Jun. 11, 2011, 151-157.

Winter, V, Amos G., et al., "Localized fluidization burrowing mechanics of Ensis directus", The Journal of Experimental Biology, Vo. 215, The Company of Biologists Ltd, 2012, 2072-2080.

Winter, V, A. G., et al., "Razor clam to RoboClam: burrowing drag reduction mechanisms and their robotic adaptation", Bioinspiration & Biomimetics, vol. 9, IOP Publishing Ltd., U.K., 2014, 1-11.

Xiao, Taoli , et al., "Experimental Study of an Inflatable Recyclable Anchor", Advances in Materials Science and Engineering, vol. 2018, Article ID 6940531, 2018, 1-10.

Youtube , "Permanent Inflatable Bridge Plug (PIBP)", https://www.youtube.com/watch?v=joZdSK1E5ig.

* cited by examiner

LATERALLY EXPANDED CAPACITY-ENHANCED PILES AND ANCHORS

CROSS-REFERENCE TO RELATED APPLICATIONS

This application claims priority to and the benefit of the filing of U.S. Provisional Patent Application No. 63/525,906, entitled "Laterally Expanded Capacity-Enhanced Piles and Anchors", filed on Jul. 10, 2023, and the specification thereof is incorporated herein by reference.

STATEMENT REGARDING FEDERALLY SPONSORED RESEARCH OR DEVELOPMENT

This invention was made with government support under Contract No. EEC-1449501, New Mexico State University Sub-award No. 15-740, awarded by the Center for Bio-mediated and Bio-inspired Geotechnics of the National Science Foundation. The government has certain rights in the invention.

BACKGROUND OF THE INVENTION

Embodiments of the present invention relate to an anchor and/or a foundation pile and/or cased bored pile (also referred to as cased drilled shaft or piers) and/or micropile and/or soil nail and/or tieback and/or tiedown (individually and/or collectively hereinafter referred to as "anchor", "pile", and/or "anchor/pile" and the plural thereof "anchors/piles", being made of a material and/or having a tube or shell or casing (referred hereinafter as a "casing") which can be forced into plastic and/or permanent deformation after the anchor and/or pile is installed in the ground, thus increasing the load carrying capacity of the anchor and/or pile. Embodiments of the present invention can be used for virtually any type of pile and/or anchor. Accordingly, the term "anchor/pile" and "anchors/piles" can include one or more of driven piles, vibrated piles, jacked piles, bored piles, drilled shafts, or cast-in-place piles, micropiles, ground anchors, tiebacks, tiedowns, hollow soil nails, steel pipe piles. Embodiments of the present invention can produce anchors/piles which are stronger in their load holding power than similarly sized, non-expanded anchors and/or piles. Embodiments of the present invention can also be implemented in an existing deep foundation or ground anchor, including for example, those composed of a tube or shell for the purpose of increasing the anchor/pile capacity, and can allow them to be reused to support a new or added structure.

BRIEF SUMMARY OF EMBODIMENTS OF THE PRESENT INVENTION

Embodiments of the present invention relate to a method for providing an anchor and/or pile including disposing an expansion member within a casing, activating the expansion member such that the expansion member presses against an internal surface of the casing with sufficient force to induce plastic deformation of at least a first portion of the casing, thereby creating at least a first enlarged area of the casing, optionally removing and reusing the expansion member, and using at least the casing as the anchor and/or the pile. Optionally, using at least the casing as the anchor and/or the pile can include using at least the casing as the anchor and/or the pile by applying a load thereto. In the method, using at least the casing as the anchor and/or the pile can include using the casing as the anchor and/or pile to resist a pulling force of a structure. In the method, using at least the casing as the anchor and/or the pile can include using the casing as the pile to resist a lateral force and/or moment of a structure. In one embodiment, using at least the casing as the anchor and/or the pile can include using the casing as the pile to support a load created by a weight of a structure. The method can include filling at least a portion of the casing with a filling material. Optionally, filling at least a portion of the casing with a filling material can include filling a least a portion of the casing with a grout.

The method can include disposing a top plate on an upper end portion of the casing, disposing an anchor rod, which can include a bar or strand or multi-stranded member within the casing, and/or coupling at least one connection point to the casing. In one embodiment, after inducing plastic deformation of at least a first portion of the casing, the method can include allowing the expansion member to contract, moving the expansion member to another location within the casing, activating the expansion member such that the expansion member presses against an internal surface of the casing with sufficient force to induce plastic deformation of at least a second portion of the casing, thereby creating a second enlarged area of the casing or extending the length of the first enlarged portion of the casing.

Disposing an expansion member within the casing can include disposing a hydraulically expandable member within the casing, which can include disposing a hydraulically expandable bladder (also referred herein as inflatable bladder) within the casing. Optionally, the method can further include removing an upper portion of the casing and leaving a lower portion of the casing. In one embodiment, the method does not include providing slits or other openings in a location of the first portion of the casing. The method can include disposing the casing at least partially within the ground and/or can include reusing an existing anchor or pile by disposing the expandable member therein and activating it so that one or more expanded areas are formed in the reused anchor or pile.

Embodiments of the present invention also relate to a method for providing an anchor and/or a pile comprising disposing a hollow casing at least partially below ground, disposing an expansion member within the casing, activating the expansion member such that the expansion member presses against an internal surface of the casing with sufficient force to induce plastic deformation of at least a first portion of the casing, thereby creating at least a first enlarged area of the casing, deactivating the expansion member and removing the expansion member, pulling the casing with the at least first enlarged area out of the ground, thereby densifying soil at least partially surrounding a void in the ground, filling the void with a filling material, and using at least the filling material as the anchor and/or the pile. Optionally, filling the void with a filling material can include filling the void with a grout and may include at least one anchor rod. In one embodiment, filing the void with a grout can include pumping the grout into the void while pulling the casing out of the ground. The method can also include installing at least one anchor rod, which can optionally include a bar, rebar, and/or one or more stranded members within the void prior to filling the void with the filling material and/or can include disposing a top plate at or near an upper end portion of the filled void. Optionally, disposing an expansion member within the casing can include disposing a hydraulically expandable member within the casing. In one embodiment, the method does not include providing slits or other openings in the casing at the first portion location.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings.

DETAILED DESCRIPTION OF THE INVENTION

Figure 1:
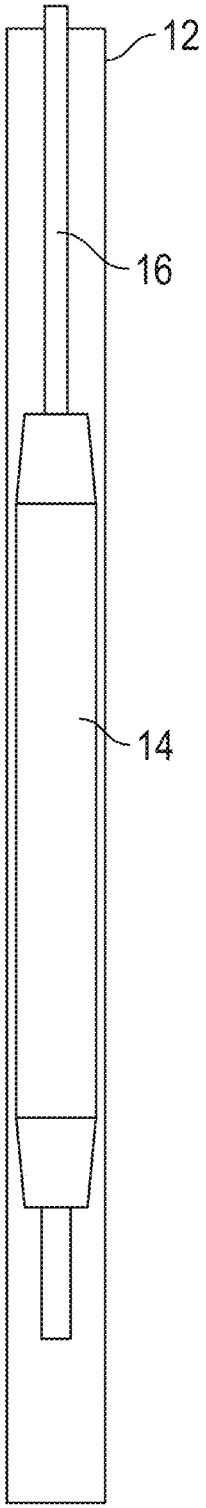
FIG. 1 is a drawing which illustrates a longitudinal cross-sectional view of a portion of a casing with an expansion member disposed therein.
Figure 2:
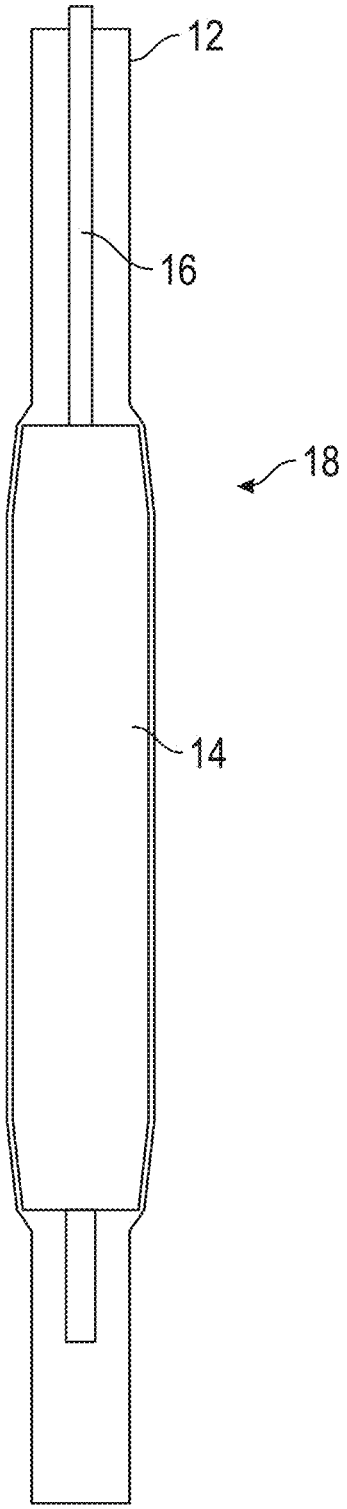
FIG. 2 is a drawing which illustrates the embodiment of FIG. 1 after the expansion member has been expanded, thus expanding a surrounding portion of the casing.

Embodiments of the present invention relate to a laterally expanded capacity-enhanced piles ("LECE-P") and/or a laterally expanded capacity-enhanced ground anchor ("LECE-A"). For simplicity, LECE-P and LECE-A are collectively and individually hereinafter referred to as "anchor/pile" and/or "anchors/piles".

Referring now to the drawings, in one embodiment, anchor/pile 10 can include casing 12, which can be expanded by expansion member 14. In one embodiment, expansion member 14 can include a hydraulically expandable bladder that is preferably fed through one or more hydraulic supply line 16. The motive force can be provided for example via a hydraulic pump and reservoir (not shown) that can be positioned at a ground surface or otherwise in a convenient location (including for example a truck and/or trailer mounted unit and/or can optionally be provided on skids. In one embodiment, the pressure of fluid in supply line 16 can be pumped at any desired pressure in order to provide plastic deformation to the casing against which expansion member presses—for example, in one embodiment the hydraulic pressure can be from about 1,000 pounds per square inch ("PSI") up to 20,000 PSI and more preferably from about 3,000 PSI to about 10,000 PSI. The amount of pressure used can be determined at least partially by the yield strength of casing and thickness of the wall of casing 12.

Figure 4A:
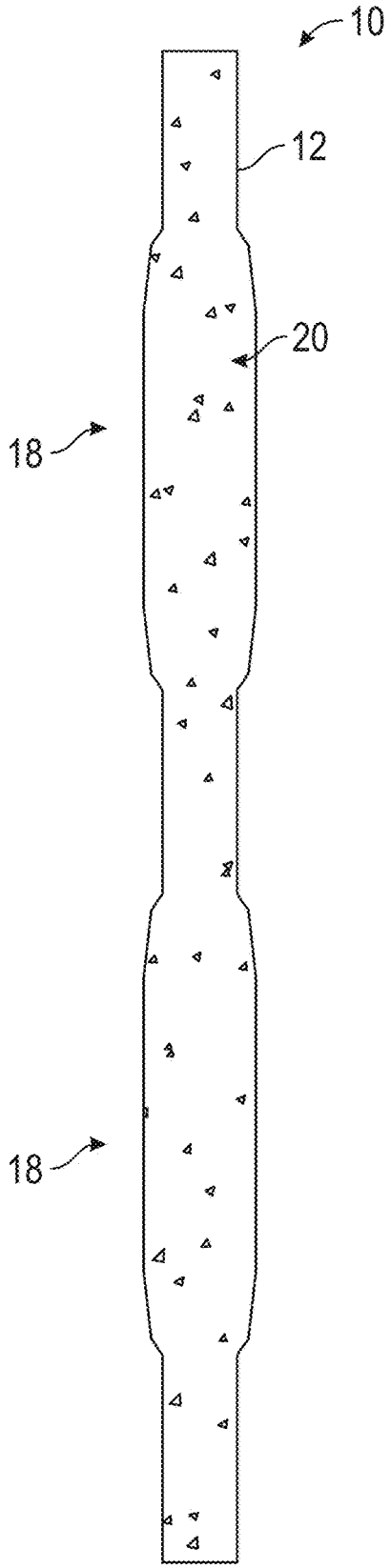
FIG. 4A is a drawing which illustrates a longitudinal cross-sectional view of a portion of a casing that has been expanded in two locations and which has been filled with a filling material.

Anchor/pile 10 can be installed into the ground using conventional methods used in the industry and subsequently can be deformed permanently (for example via plastic deformation), in its radial direction, along one or more portions or along all of the anchor/pile length using expansion member 14. The anchor/pile system can include one or more laterally (or radially) expanded (deformed) portions along the anchor/pile length and can include a driving shoe, cutting teeth and/or baseplate (e.g., made of steel or other material, either welded or attached or not) at an end portion of the casing. When it is desired for the anchor/pile system to have two or more expanded portions 18, separated by unexpanded portions (see FIG. 4), or when it is desired for an expanded portion to be formed which is longer than a length of expansion member 14, the expansion process can be completed in stages, thus forming one or more expanded portions 18 sequentially. Alternatively, a plurality of expansion members 14 can be inserted into casing 12 and expanded simultaneously, thus simultaneously producing a plurality of expanded portions 18 and/or forming an expanded portion 18 having a length greater than that of a single expansion member 14. Anchor/pile 10 can include filler material 20 which can be disposed within the expanded portion of casing 12 and/or which can be filled within the entirety of casing 12 or any other desired amount of casing 12. In one embodiment, filler material 20 can optionally include, for example, any one or more of: cement, grout, concrete, epoxy, soil, crushed stone, sand, combinations thereof and the like, which can be added after the expansion has been completed, and which can include reinforcement material or members in the case of bored piles, including but not limited to steel reinforcing.

In one embodiment, filler material 20 is a solid material and/or a liquid that is configured to set and/or sure into a solid material. In one embodiment, one month after installation, and preferably within a week of installation, filler material 20 comprises a solid material, which can optionally include a granular material. In one embodiment, after installation before a load is applied to anchor/pile 10, a filler material 20, comprising a solid material is preferably disposed within casing 12—most preferably filling at least 25% of an internal area of casing 12 and more preferably filling an internal area of at least 75% of an internal area of casing 12 and most preferably filling at least 95% of an internal area of casing 12.

Casing 12 can be formed from a rigid but deformable member, including for example a tube or pipe, which is preferably formed from a strong rigid material, and which can include for example a metal material—most preferably steel, which can include mild steel, stainless steel, aluminum, and/or one or more polymer materials. Casing 12 is hollow and can have a circular, square, rectangular, octagonal, or other cross-sectional shape, that is installed into the ground (e.g., by driving, vibrating, drilling, screwing, jacking, or otherwise inserting into a pre-formed hole), with an open or closed end.

Once casing 12 has been installed in the ground (including for example a soil and/or rock material), one or more expansion members 14, which can include for example one or more inflatable bladder systems, which can include for example a packer, other expanding devices that expand due to hydraulic or mechanical action, can be inserted into the casing 12. For example, one or more pressurized bladders, scissor jacks, hydraulic jacks, an exhaust pipe-type and/or other pipe expander tools can be used—including but not limited to tools whereby one or more parts are forced outwards and radially against the inner wall of casing 12 and are preferably retrieved (although retrieval is not required) after one or more expanded portions 18 have been formed in casing 12. An embodiment of this can include, for example, tools where a wedge-shaped mandrel is forcibly pushed into, or retracted into, surrounding jaws that are thus forced radially outward, the force of which causes casing 12 to expand.

Optionally, after a first portion of casing 12 has been thusly expanded, expansion member 14 can optionally be slightly rotated while held at the same depth to expand again and obtain a casing expansion with uniform—or if desired non-uniform, diameter. Alternatively, expansion member 14 can be placed inside casing 12 before installing casing 12 into the ground, either permanently affixed or temporarily installed therein. If the expansion members are hydraulically activated, they are preferably filled with liquid, which can include, but is not limited to, water, oil, or other hydraulic fluid which is preferably pressurized with a controlled pressure or a material that reacts (including for example an expansive grout) to create pressure against the internal walls of casing 12 to cause plastic deformation of the material of casing 12 and push the walls outwards radially by a desired distance or selected fluid pressure, and at desired location(s). The pressure causes permanent plastic deformation of casing 12 material, increasing the diameter (or perimeter) thereof over the length of the area where expansion member 14 pressed.

In one embodiment, casing 12 is preferably provided. If expansion member 14 is a hydraulically expandable bladder, then one or more supply lines 16 (which can include but is not limited to a hose, tube and/or pipe) is preferably coupled to an interior of the bladder of expansion member 14, which is configured to expand when fluid is forced into it through the one or more supply lines 16. The expansion of expansion member 14 pushes casing 12 outward, forming expanded portion 18.

Figure 3:
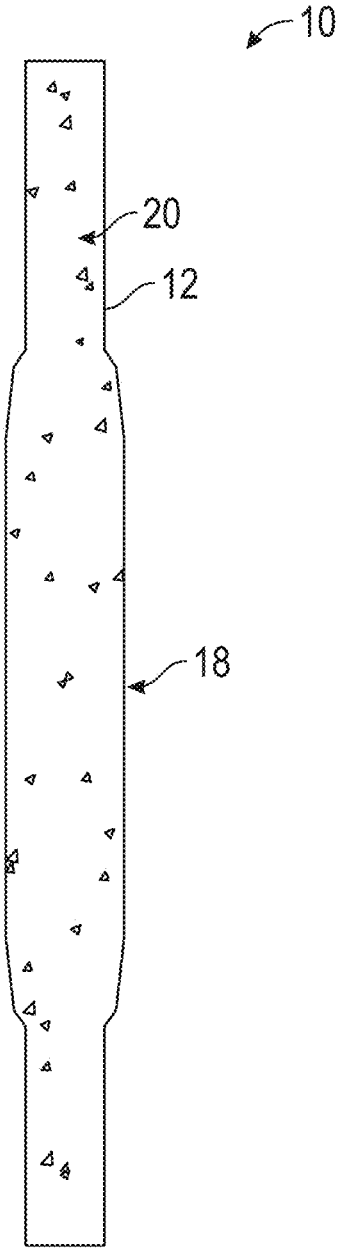
FIG. 3 is a drawing which illustrates the embodiment of FIG. 2 after the expansion member has been contracted and removed from the casing and after the casing has been filled with a filling material.

One or more expanded portions 18 can be formed in a single casing. Optionally, if a plurality of enlarged areas 18 are desired, a single expansion member 14 can be used repeatedly, or a plurality of expansion members 14 can be used. For example, a single expansion member can be used to enlarge a first area of casing 12. The expansion member can then be at least partially retracted and repositioned at another location in casing 12 before the expansion member is again activated to form a second expanded portion. Optionally, however, a plurality of expansion members 14 be disposed within a single casing 12 and can be expanded simultaneously or can be expanded individually or sequentially in groups. After the one or more expanded areas 18 are formed in casing 12 and preferably after expansion member 14 has been removed, filler material 20 can be disposed within casing 12 (see FIGS. 3, 4A, and 4B).

In one embodiment, expansion member 14, or part of it, can be left permanently inside casing 12 if desired, thus providing a "sacrificial" use of expansion member 14. Optionally, if an expandable bladder is used as the expansion member, and if it is desired to leave the bladder in place, in one embodiment, the bladder can be filled with filler material 20. The formation of one or more expanded areas 18 inside the ground preferably increases the soil and/or rock confining stress against anchor/pile 10, over the expanded portion, thus significantly increasing the friction (shaft) resistance over the expanded portion, consequently significantly increasing the friction (shaft) capacity of the anchor/pile. In addition, the transition areas of anchor/pile 10 between the expanded and non-expanded portions can provide additional end bearing capacity to the system (namely, pile, drilled shaft, micropile, soil or rock anchor, tieback, tiedown, or soil nail). This mechanism works when anchor/pile 10 is loaded in axial compression or tension and can help to increase lateral load capacity of the expanded anchor/pile 10. An increase in the perimeter of casing 12 can increase the capacity of anchor/pile 10, which can include for example an increase in compression (downward) capacity, and/or tension (uplift or pullout) capacity, and/or lateral capacity. Optionally, load-carrying capacity can be increased from an increase in the anchor/pile perimeter in one or multiple locations along a length of casing 12.

Expanded anchor/pile 10 can provide a considerable economical advantage by increasing the load-carrying capacity of the anchor or pile, thus reducing the required length and/or diameter of the entire anchor/pile 10 that would otherwise be needed and/or reducing the number of anchors or piles that would be needed compared to conventional anchors or piles. Embodiments of the present invention also provide enhanced sustainability and economical advantage by allowing the reuse and capacity increase of existing steel pipe piles after the original structure (for example a bridge, overpass, transmission tower, building, or billboard) has been demolished and/or removed. Embodiments of the present invention also provide enhanced sustainability by reducing materials and the environmental impacts of installation (for example less gas emissions, faster installation, less materials are needed). Capacity enhancement is preserved over time because plastic deformation of the casing occurs, and thus the shape and/or size change is permanent. The use of expansion member 14 preferably allows enlargement of the perimeter radially, which can include for example symmetrically about a primary axis of casing 12, or just over a target portion of a perimeter of casing 12.

Embodiments of the present invention can be used by civil engineering and geotechnical engineering design firms and construction specialty companies, particularly those that install deep or pile foundations, drilled shafts or bored piles, micropile foundations, soil/rock anchors, tiebacks and tie-downs, soil nailing, solar panel farms (also referred to as solar collector fields), combinations thereof and the like.

The expanded anchor/pile 10 has significantly greater axial capacity and potentially increased lateral capacity through lateral expansion of casing 12 compared to conventional piles and/or anchors of similar dimensions.

Optionally, casing 12 of the anchor/pile 10 can be made from a metal material, including but not limited to a stainless steel, which can include but is not limited to, for example, schedule 10 steel pipe, welded. Optionally, casing 12 of anchors/piles 10 can be formed from mild steel. In one embodiment, anchor/pile 10 can be made to any desired length and can be embedded to any desired depth in the ground. The inside diameter can be any desirable dimension. Optionally, casing 12 can be unmodified tubes or pipes (for example, they are not split longitudinally and do not require any other weldments or modifications in order to be used as casing 12 in anchor/pile 10).

In one embodiment, casing 12 of anchor/pile 10 preferably expands radially, but can optionally differ in the total amount of expansion and in the type of expansion mechanism, and different filler material 20 after expansion, or whether they are preloaded axially. In one embodiment, the expanded anchor/pile 10 can be filled with concrete grout (most preferably non-shrinkage concrete grout) to add structural integrity to anchor/pile 10. The concrete grout can help ensure anchor/pile 10 will not deform during axial compression or tension loading. Optionally, the anchor/pile 10 can be loaded axially and/or laterally. They can optionally be expanded using an inflatable bladder and loaded in axial compression. In one embodiment, anchor/pile 10 are preferably expanded using an inflatable bladder prior to axial and/or lateral loading. Anchor/pile 10 can include end 28 (see FIG. 5), which can provide any desired function. For example, end 28 can comprise one or more teeth, a baseplate to form a closed end, a driving shoe or ring, a penetrating nose cone or any other shape, structure, or combination thereof which provides one or more desired functions—particularly for aiding in placement of casing 12. Optionally, however, casing 12 can be open on its terminal end portion.

In one embodiment the anchor/pile 10 can be driven, jacked, pushed, drilled or vibrated into the ground (i.e., soil, rock, weathered rock). Optionally, however, the anchor/pile 10 can be buried in the ground and soil or another substance, including for example, crushed stone or aggregates, can be placed and/or compacted around them.

Optionally, anchor/pile 10 can be expanded radially using pre-existing equipment and/or customized equipment. For example, expansion member 14 can optionally include an inflatable bladder system—including for example of the type conventionally used for groundwater control, pre-excavation grouting, underground exploration drilling, and other applications. In one embodiment, if an inflatable bladder is used, it can optionally include an end pipe at its lower end with a rubber seal to connect to one end of the bladder. The seal, which can optionally be formed from an elastomeric material, including but not limited to a rubber material, preferably prevents leaks when pressurized. The end pipe can rest on a baseplate inside of casing 12 if it is closed-ended, or on the ground at the bottom of casing 12 if it is open-ended or can be affixed or temporarily placed at any desired location inside casing 12. Expansion member 14 can be any desired length and can optionally be a single expansion member or a series of expansion members. If a bladder is used, a lower end portion thereof can optionally connect for example to another pipe with a seal to prevent leaks when pressurized or the lower end of the bladder can otherwise be sealed. If a lower pipe is provided on the bladder, it can optionally be connected to a second bladder, and/or can be connected to a plurality of other bladders. This is also the case for expansion members other than bladders—namely a plurality of expansion members 14 can be used simultaneously and/or sequentially. All the components of the inflatable bladder system are preferably rated for at least the desired pressure to inflate the bladder and expand casing 12. Expansion member 14 is preferably inserted into casing 12 of anchor/pile 10. After expansion member 14 has expanded to the desired diameter, it is preferably caused to retract and is moved to another location in the same casing for another expansion, or alternatively is removed from the casing and inserted into another casing of another anchor/pile 10 for expansion. After expansion and after the expansion member 14 is removed from the inside of casing 12, optionally anchor/pile 10 can be filled with filler material 20 prior to axial and/or lateral loading. In one embodiment, to determine when a desired diameter has been obtained while using an inflatable bladder system, a calibration test, which can be referred to as an "open-air test" can be performed. For this test, the expansion member is inserted in a piece of casing that has not been installed in the ground, and measure, simultaneously, the following, as the bladder is expanded: 1) the increase in diameter of the uninstalled casing, 2) the pressure used to inflate the bladder, and 3) the volume of nearly incompressible fluid, such as water or oil, that is pumped into the bladder to inflate it. In this way, a user can correlate a given pressure and fluid volume with a resulting diameter increase. The results of this can be charted and from the chart, a user can select the pressure and fluid volume that will give approximately the desired diameter increase in the ground.

Figure 4B:
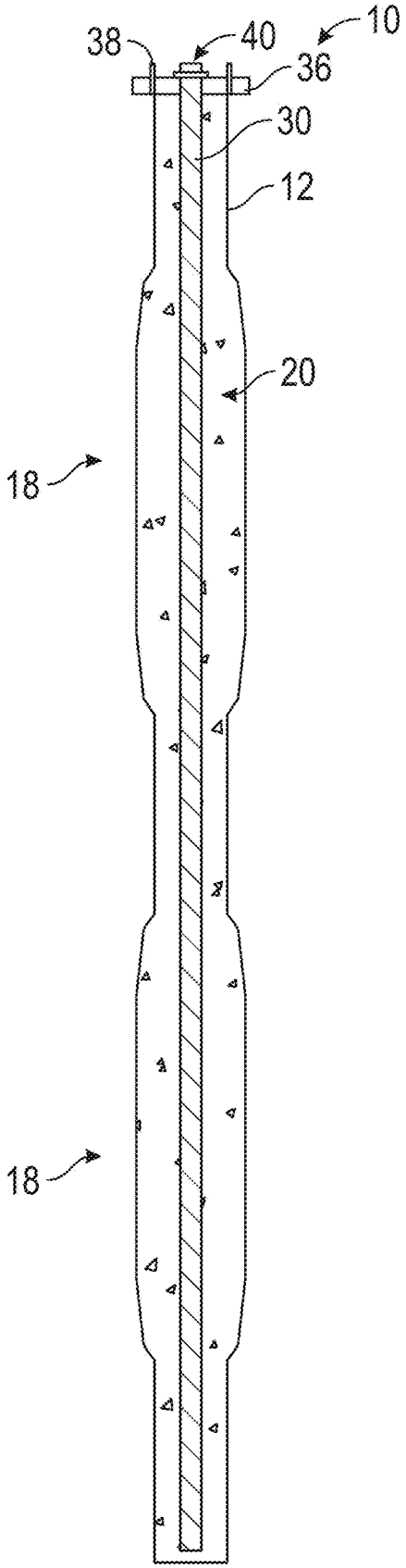
FIG. 4B is a drawing which illustrates a longitudinal cross-sectional view of a portion of a casing that has been expanded in two locations, with an anchor rod disposed therein, and which has been filled with a filling material.
Figure 12:
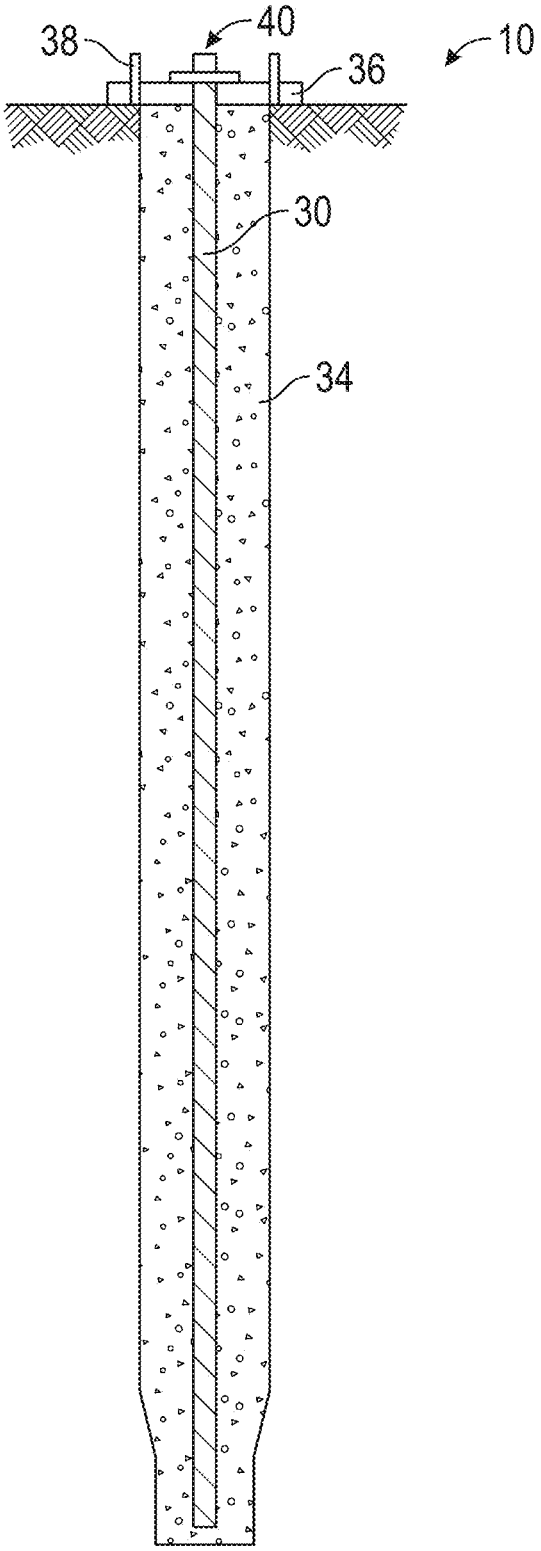

Although in one embodiment, casing 12 is preferably left in place and can include insertion of anchor rod 30 (see for example FIGS. 4B and 12). In one embodiment, anchor rod 30 need not comprise an actual rod but can optionally include a cable and/or wire rope, pipe tubing or other structure which is desired to be disposed within anchor/pile 10. For example, in one embodiment, anchor rod 30 can comprise a threaded rod, which can optionally be used for pre-tensioning and/or to otherwise provide a connection point for anchor/pile 10. In one embodiment, anchor rod 30 can comprise a tieback tendon or one rods one or more rebar, one or more strands or stranded members, one or more cables or wire ropes, combinations thereof and the like. Optional, anchor rod 30 need not be provided. Anchor rod 30 can optionally be disposed in an anchor/pile 10 that is intended to be used as a pile or an anchor. Optionally, anchor rod 30 can be inserted into casing 12 before or after the formation of expanded areas 18. In one embodiment, anchor rods 30 can be held in place using spacers to make sure the anchor rods do not touch the sides of casing 12 or sides of the hole. Optionally, there can be a plurality of anchor rods 30 provided for a single anchor/pile 10. Optionally, anchor rods 30 can be covered by a sheathing material, which can include for example a coating (including but not limited to an epoxy coating or galvanization) or a corrosion inhibiting compound under extruded or corrugated high density polyethylene and polypropylene material), to protect anchor rod 30 from corrosion and/or other damage during installation and service.

As best illustrated in FIG. 12, top portion 40 can include top plate 36 and one or more connection points 38 and any other structures or features which are desirable. Top plate 36 need not comprise a strictly plate-like shape—instead, any desired covering and/or partial covering can be provided and regarded as a top plate, including but not limited to a pipe endcap. Depending on the desired usage, attachment points 38 can comprise one or more: rebar, bolts, eye loops, combinations thereof and the like. Optionally, one or more of attachment points 38 can themselves comprise a portion of anchor rod 30.

Figure 5:
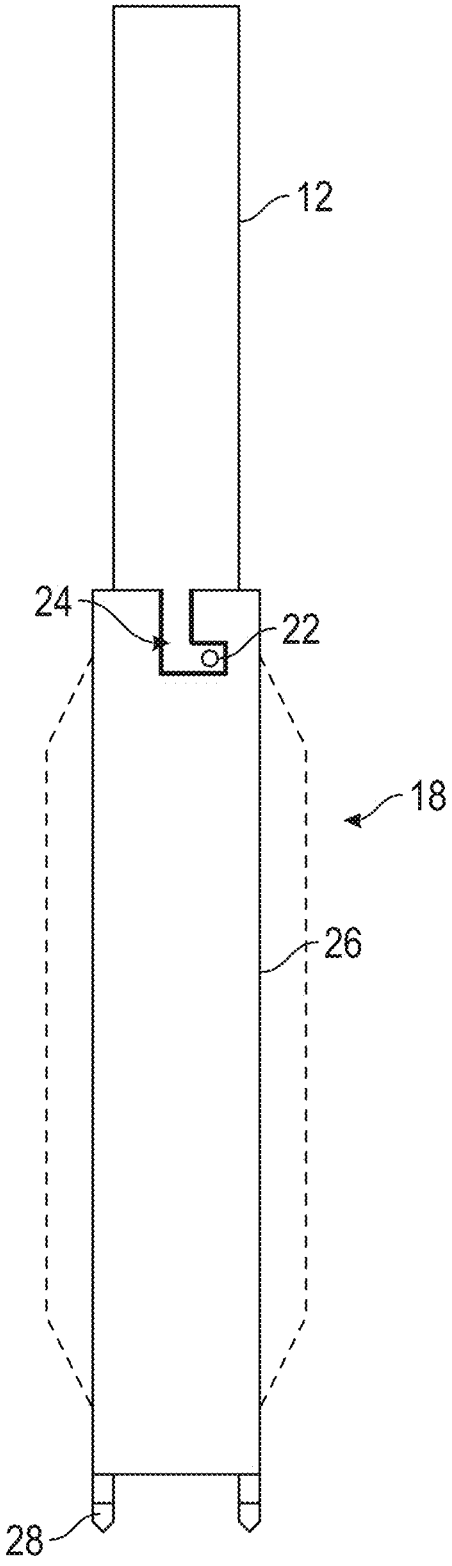
FIG. 5 is a drawing which illustrates an embodiment of the present invention wherein a removable casing section can be expanded and then separated from a remainder casing portion and which illustrates cutting teeth disposed on a bottom portion of the removable casing section.
Figure 6:
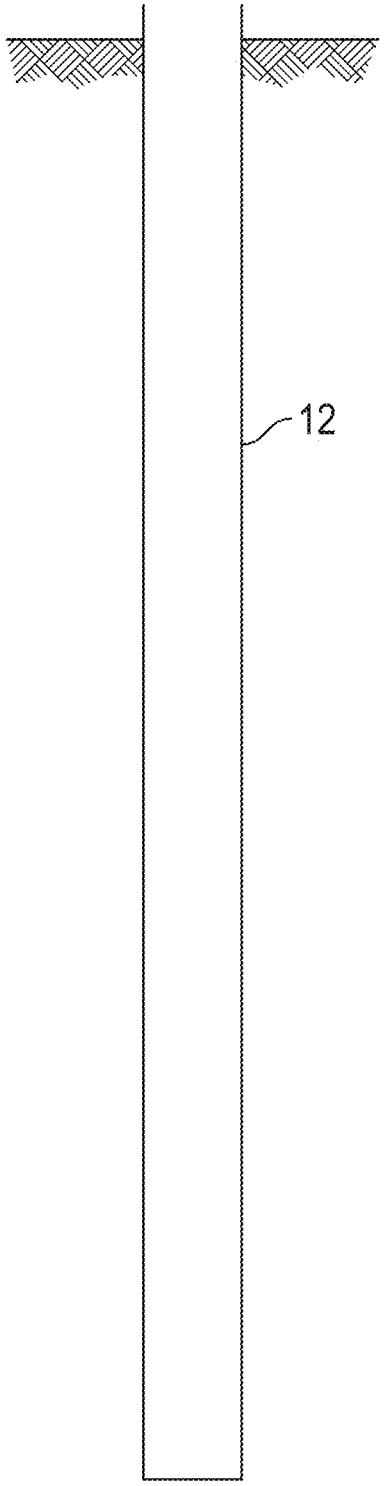
FIGS. 6, 7, 8, 9, 10, 11, and 12 are a series of drawing which illustrates steps that can be performed to provide an expanded pile or anchor beginning with a casing disposed into the ground (FIG. 6), an expansion member disposed within the casing (FIG. 7), the expansion member being expanded, thus expanding the surrounding casing (FIG. 8), the resulting expanded casing after the expansion member has been removed (FIG. 9), an anchor rod can be disposed within the casing (FIG. 10), the casing being pulled out while the resulting hole is back-filled with grout (FIG. 11), and the completed pile or anchor after a top plate and any desired connecting components have been applied thereto (FIG. 12)
Figure 7:
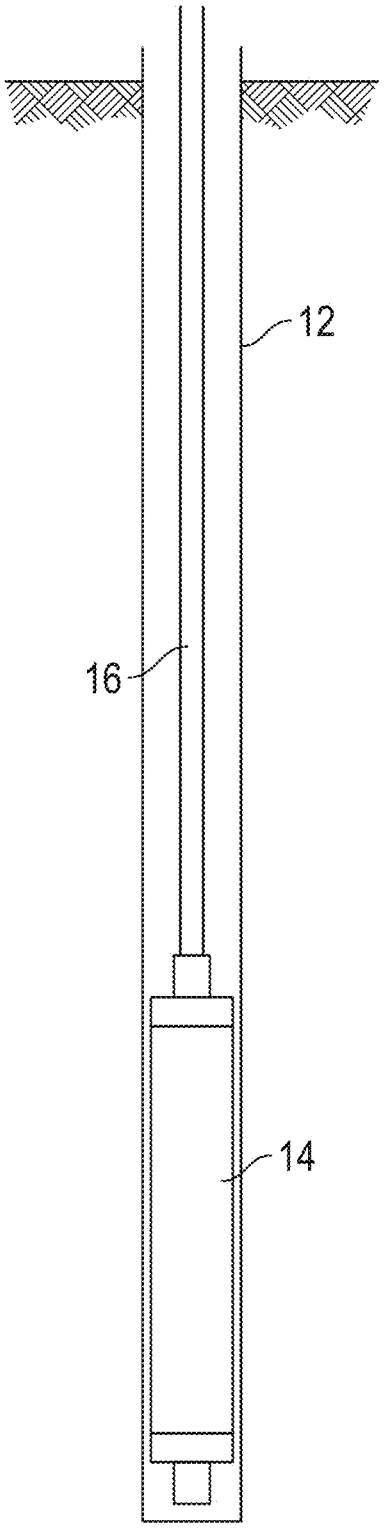
Figure 8:
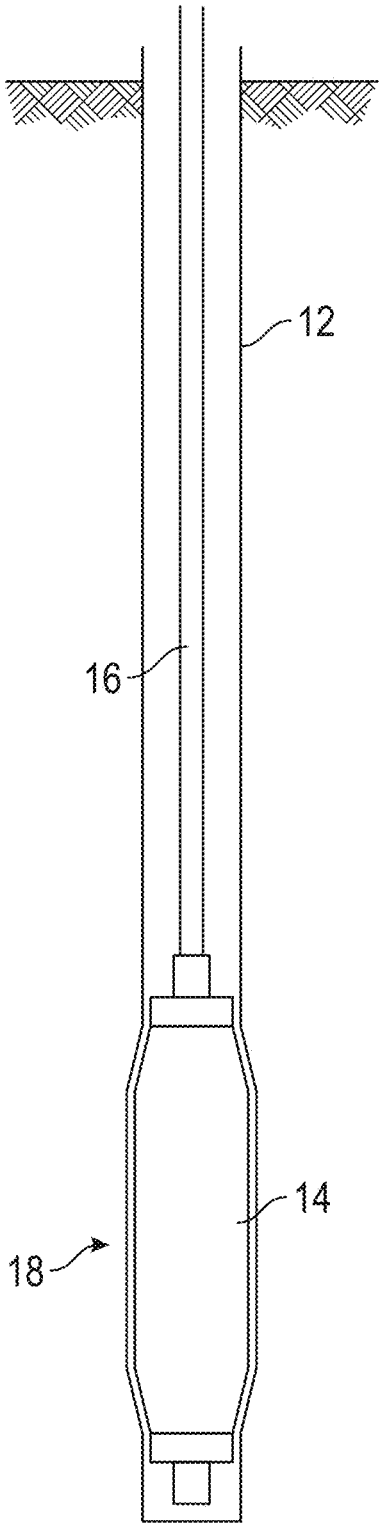
Figure 9:
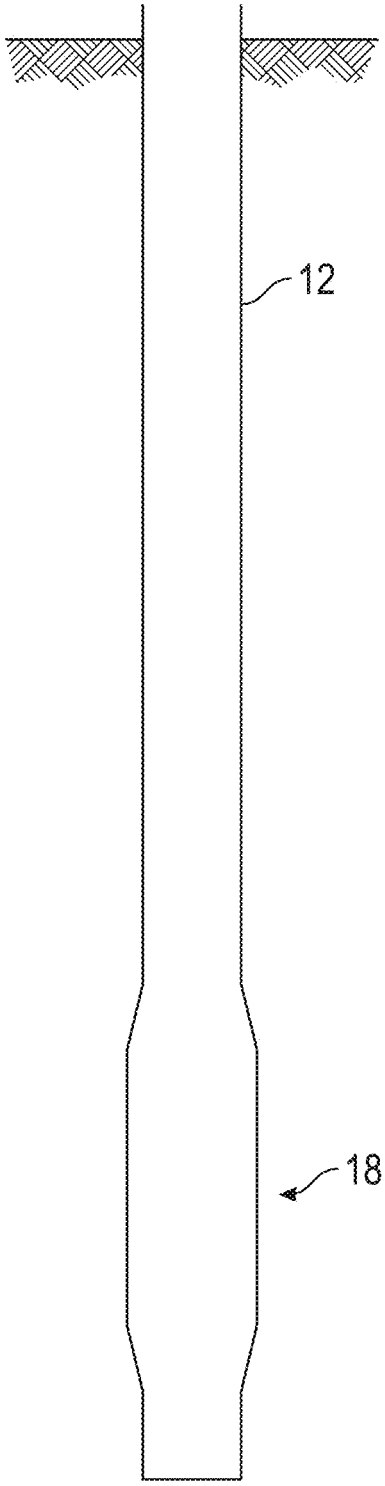
Figure 10:
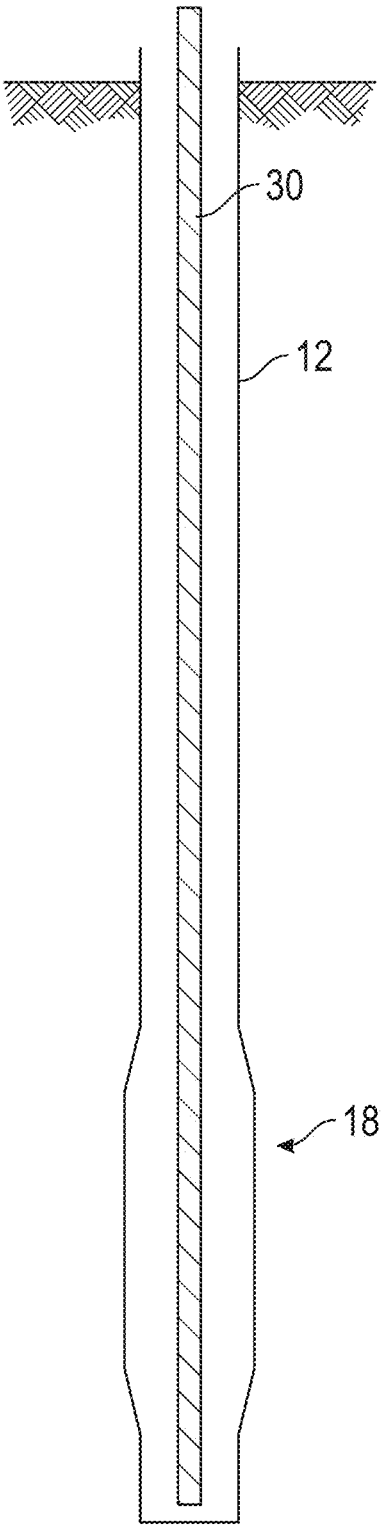
Figure 11:
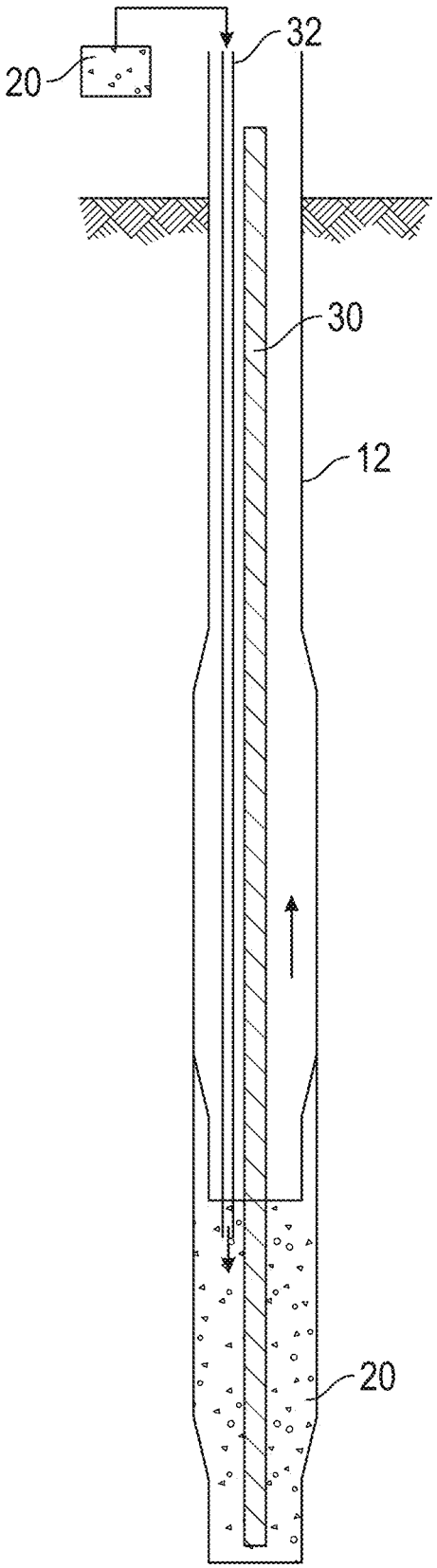

As best illustrated in FIG. 5, in one embodiment, casing 12 can be formed into two separate components such that an expanded portion of casing 12 can be left in place while the remainder of casing 12 is withdrawn and can optionally be used for placing other casings of other anchors/piles 10. Optionally, of course, an upper portion of casing 12 can have a diameter which is smaller than that of the portion of casing 12 which is left in place. For example, upper casing 12 can comprise all or a portion of a release mechanism, which can include for example pin 22 which engages with slot 24. Most preferably, a plurality of pins 22 and engaging slots 24 are provided, which most preferably can include a pair of pins 22 which are offset by 180 degrees from one another (i.e. on opposing side surfaces of casing 12) and a pair of respective slots 24 positioned accordingly. Optionally, however, more pins 22 and slots 24 can be provided. Regardless of the number used, most preferably the pins are spaced evenly around the perimeter of casing 12 (i.e. for four pins, they are arranged at 90-degree intervals around casing 12). These can be released by rotating an upper portion of casing 12 in an opposite direction before it is pulled away from the expanded portion of casing 12. In this embodiment, casing 12 is lowered into an opening or is otherwise rotated in a first direction to form the opening in the ground into which an anchor/pile 10 is desired. Then, an expansion member is installed and/or otherwise activated to create enlarged portion 18 on only a lower portion 26 of casing 12. Expansion member 14 can then be removed (or optionally left in place as previously described), then the coupling mechanism is activated or otherwise caused to release and the upper portion of casing 12 is separated and withdrawn, thus leaving only lower portion of casing 26 (now expanded). Optionally, filler material 20 can be disposed within expanded lower portion 26, as well as in the hole formed above it. For example, filler material 20 can be disposed within the opening as the upper portion of casing 12 is withdrawn or before it is withdrawn or after it is withdrawn. Optionally, anchor rod 30 can be inserted into casing 12 before the formation of enlarged portion 18 and/or after the formation of enlarged portion 18.

Figure 13:
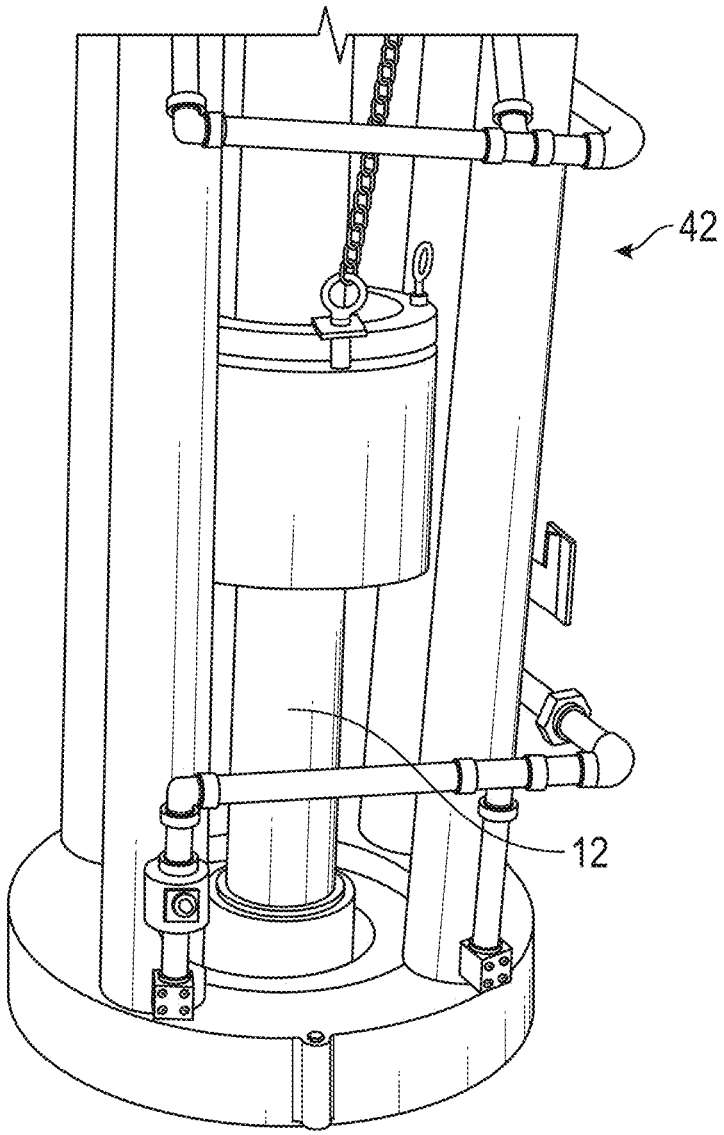
FIG. 13 is a drawing which illustrates a jack pulling expanded casing from the ground.

Although in one embodiment, all or a portion of casing 12 can be left in place after one or more enlarged areas 18 have been formed therein, in one embodiment, as best illustrated in FIGS. 6-12, casing 12 can be forcibly pulled from the ground after at least one enlarged area 18 has been formed. For example, in one embodiment, casing 12 is preferably at least partially disposed below ground, expansion member 14 is lowered into casing 12 and caused to expand, thus deforming casing 12 and forming one or more enlarged areas 18. Expansion member 14 is then removed and anchor rod 30 (if desired) is inserted down through casing 12. Filler material 20 is then passed down through casing 12 (optionally) through filler tube 32, as casing 12 if forcibly pulled out of the ground. See FIG. 13, which illustrates jack 42 that can be used to forcibly pull enlarged casing 12 from the ground. As casing 12 is withdrawn from the ground, the soil or other earth structure around casing 12 is densified by virtue of enlarged area 18 being drug back to the surface, thus further wedging open the hole and thereby compacting the material on the sides of the opening. The effect of densifying the surrounding earth increases the holding strength of anchor/pile 10, which is thusly formed by filler material 20 and anchor rod 30 (if provided). In one embodiment, filler material 20 is preferably a grout, which is preferably pumped under pressure into filler tube 32 as casing 12 is withdrawn or after casing 12 has been withdrawn. Optionally, jack 42 can be a stand-alone unit and/or can be a skid-mounted unit or otherwise be an attachment for a piece of equipment—for example it can be an attachment to an excavator.

After casing 12 has been removed top portion 40, including any desired connection points 38 and/or top plate 36 can be provided as previously described, thus producing anchor/pile 10 as illustrated in FIG. 12 without a casing. In one embodiment of this multiple part casing system, optionally, only the enlarged areas that are left behind can be filled with filler material 20 and the remaining portion of the thusly-formed hole can be backfilled with soil, rock and/or other debris that were removed during the placement of casing 12.

Figure 14:
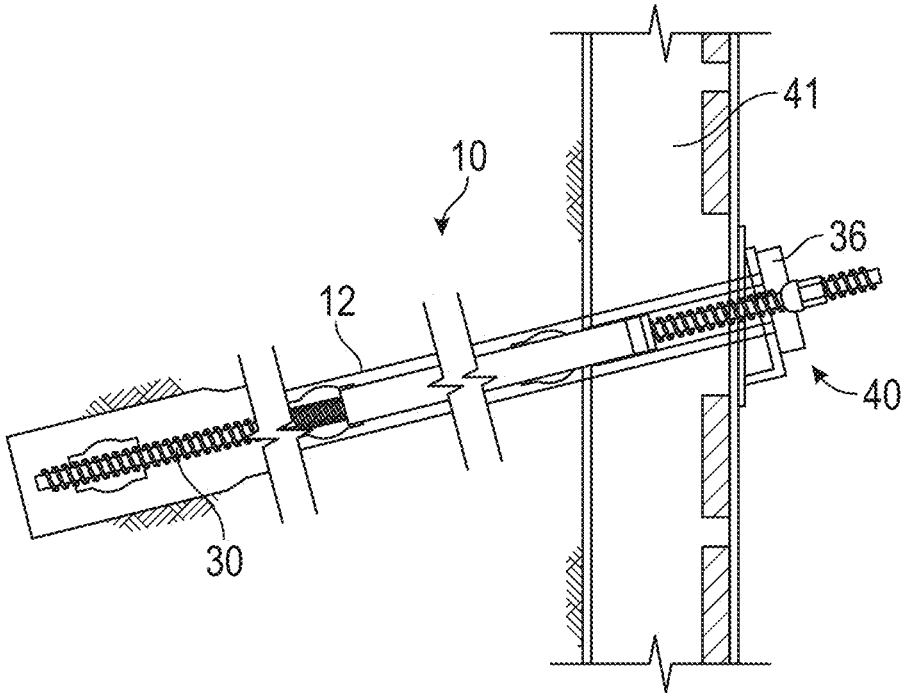
FIG. 14 is a drawing which illustrates an expanded anchor that remains connected to the rest of the casing and which anchor is used to secure a soldier beam.
Figure 15:
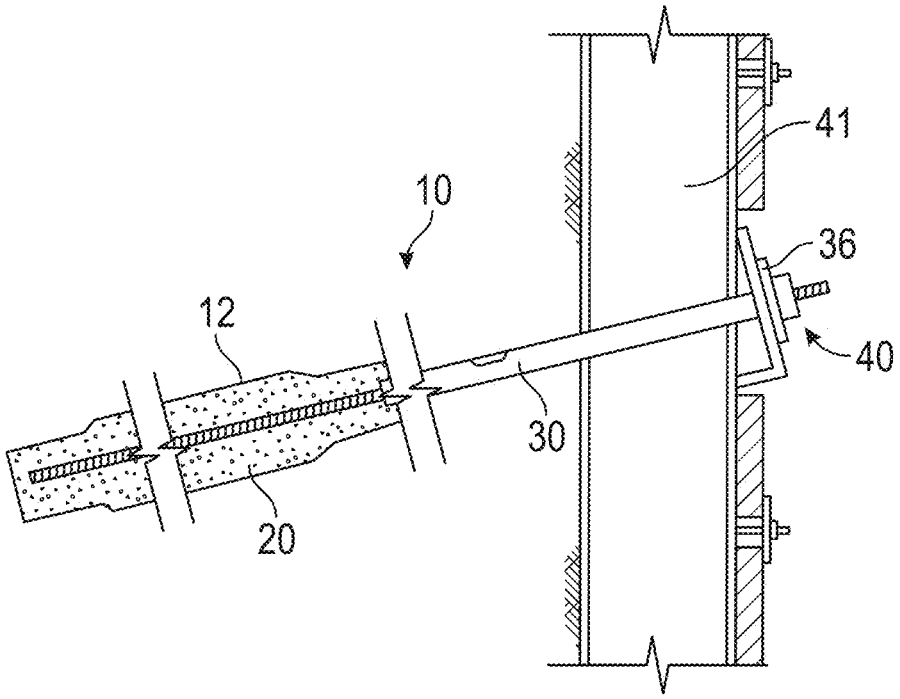
FIG. 15 is a drawing which illustrates an embodiment of the present invention wherein an expanded portion of a casing has been left behind while the remaining portion of the casing has been removed and wherein the anchor is used to support a soldier beam.

As best illustrated in FIGS. 14 and 15, anchor/pile 10 need not be positioned vertically to provide desirable results and can be disposed below ground at any desired angle and/or orientation. FIG. 14 illustrates an embodiment wherein casing 12 is a single continuous casing or a series of connected or threaded casing segments and the entirety of it is left in the ground, whereas FIG. 15 illustrates an embodiment wherein only an expanded portion of casing 12 has been left in the ground. Optionally, a hole can be drilled with casing 12, or can otherwise be formed and casing 12 inserted therein. Once the desired depth is reached, an expansion member can be disposed within casing 12 and activated to expand one or more areas where such enlarged areas are desired, after which the expansion device can be removed and anchor rod 30 can be inserted therein. Optionally, upper portion or portions of the casing can be removed while inserting filler material 20, thus leaving the expanded portion of the casing in the opening. Optionally, however, the entirety of casing 12 can be left in place and filled with filler material 20. Of course, as illustrated in prior embodiments, after expansion, casing 12 can be forcibly pulled from the ground, thus densifying the surrounding soil while also filling the void with filler material 20. Depending on the application, in one embodiment, top portion 40 can be installed on a front side of soldier beam 41, ground excavation, ground slope, embankment, or other structure. Thus, top portion 40 need not be installed directly adjacent to the ground surface.

Figure 16:
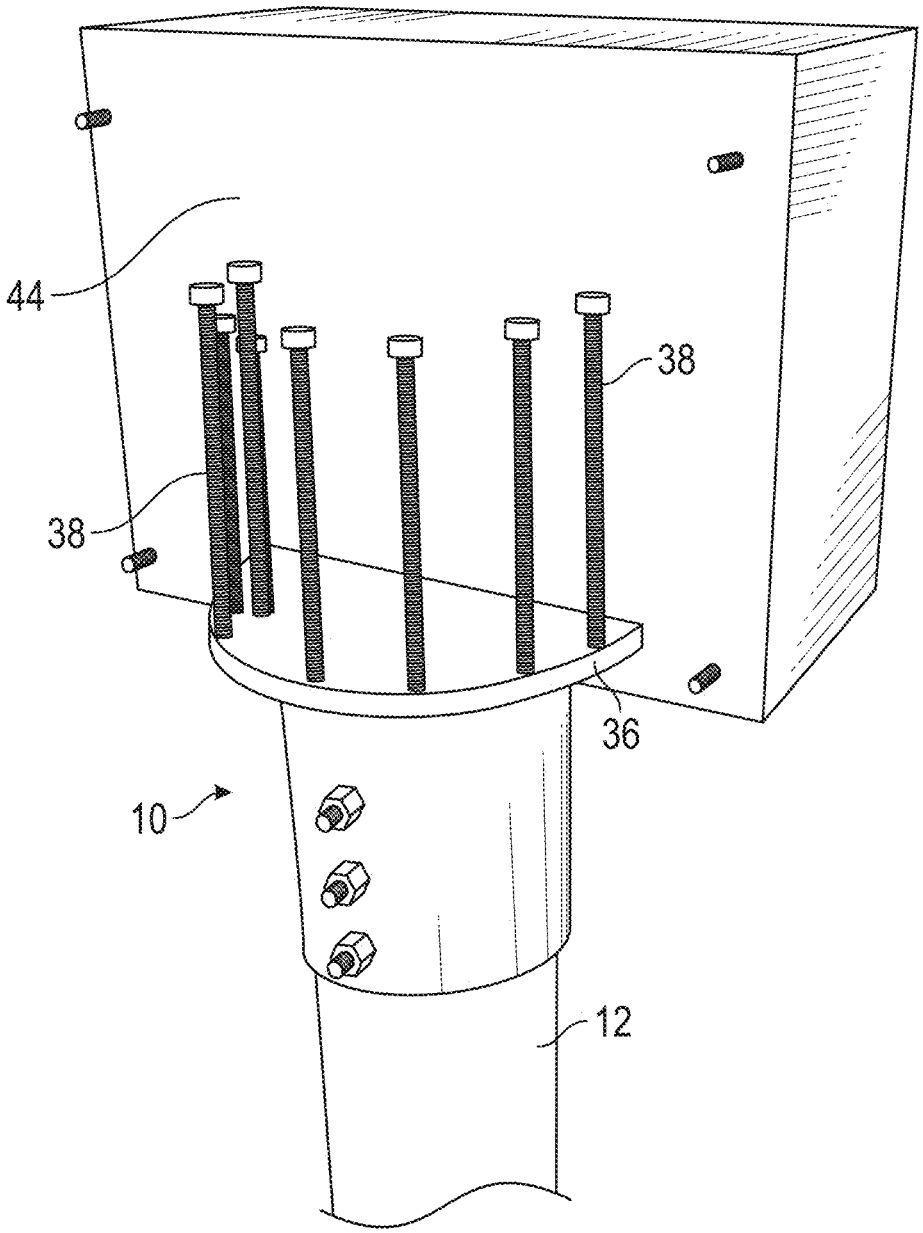
FIG. 16 is a drawing which illustrates an upper portion of a pile and wherein a portion of concrete has been removed to illustrate an internal connection between the concrete pile cap and the pile.
Figure 17:
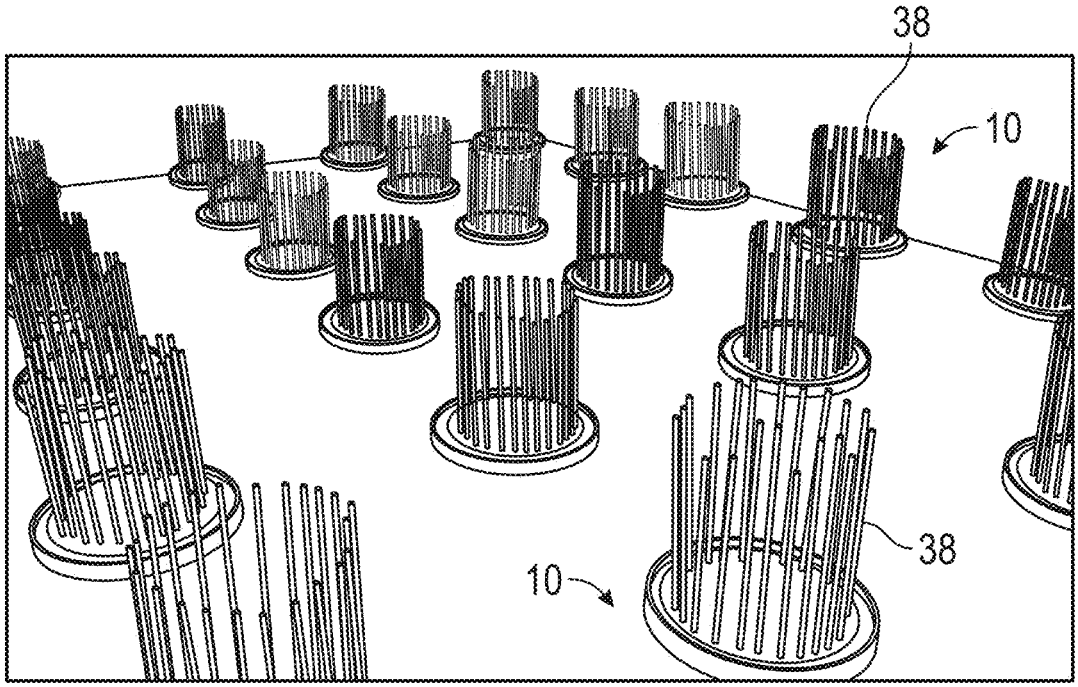
FIG. 17 is a drawing which illustrates a top portion of several piles with rebar extending above each for connection with a foundation of a structure to be constructed.
Figure 18:
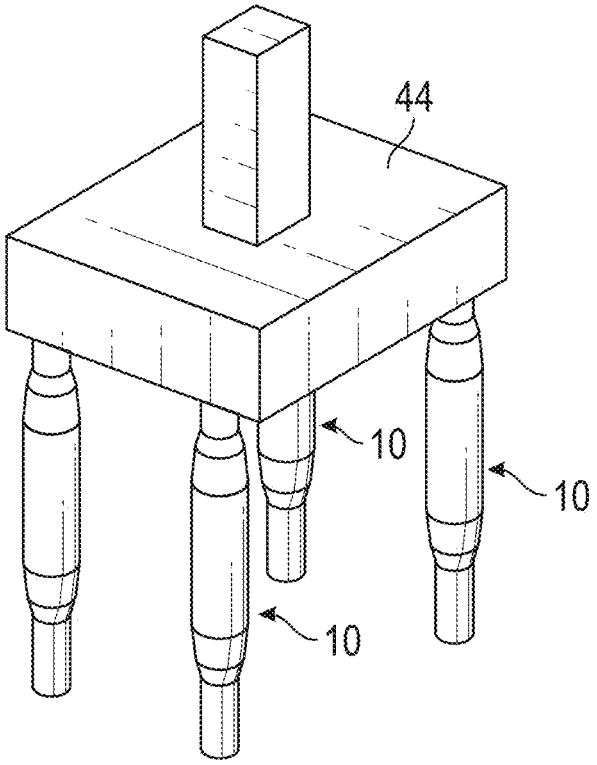
FIG. 18 is a drawing which illustrates a plurality of piles arranged to support a foundation of structure.

FIGS. 16, 17, and 18 illustrate various optional connection methods and/or use cases for anchor/pile 10. For example, as illustrate in FIG. 16, one or more rebar attachment points 38 can be attached (for example by welding it to casing 12) to or otherwise project up from anchor/pile 10 and concrete pile cap 44 can be formed thereon. Although FIG. 16 illustrates top plate 36 disposed below the concrete, in one embodiment, top plate 36 is not provided and instead rebar can extend down into casing 12, and casing 12 can be filled with concrete which also forms the concrete pile cap. FIG. 17 illustrates an embodiment, wherein a plurality of anchors/piles 10 are positioned, each which a plurality of rebar attachment points 38 attached or otherwise projecting up and around which a single large pile cap can be formed. FIG. 18 illustrates a perspective view of a similar embodiment. Although anchors/piles 10 are illustrated as being in a substantially parallel arrangement with respect to one another, they can optionally be arranged such that one or more are not parallel with one another, but instead are arranged to fan out into the earth (i.e., battered piles). When several anchors/piles 10 are installed as a group with a pile cap, all or some of the anchors/piles 10 can be expanded whereas the other ones can optionally not include an expanded portion. Optionally, casing 12 need not terminate directly at a ground level but if desired can extend above the ground level. In one embodiment, a footing can be excavated and one or more anchors/piles 10 can be installed there below. Optionally, a top portion of the one or more anchors/piles 10 can extend only to the surface of the excavated footing. Alternatively, however, one or more of the anchors/piles 10 can extend a distance above the surface of the excavated footing. And, after installing the one or more anchors/piles 10, a pile cap can be formed within the excavated footing.

For existing conventional anchors and/or piles formed from a metallic pipe and/or tube which are already in place and which are not already full of a filler material (and/or which can be rendered free of filler material), expansion member 14 can be lowered therein and expanded to increase the holding strength of the anchor or pile such that it can be reused in-situ without removing them from the ground. Because the holding strength is increased, the increased load capacity means that fewer anchors or piles are needed to provide the same or similar results and/or that shorter anchors and/or piles can be used and/or that smaller diameter anchors and/or piles can be used to satisfy the structural and loading conditions of the site and project. In addition, shorter elements (such as ground anchors) can be accomplished with embodiments of the present invention compared to conventional method to be used in industrial and urban construction sites where there is limited space and many underground structures already exist (like utilities pipelines—gas, electricity, water, sewer, communication lines, tunnels, basements and foundations of adjacent structures), and/or where the ground anchors are not allowed to extend beyond the property boundaries. These constraints complicate the deployment of conventional excavation support systems. Any disruption or damage to existing structures can have massive financial consequences. Accidental damage to these utilities during pile installation, soil nail drilling, or tieback drilling may cause service disruptions and pose safety hazards. Accordingly, such disruptions, damages, and hazards can be mitigated by using embodiments of the present invention.

In one embodiment, the casing is preferably expanded radially without first creating one or more slits, slots or other cuts or weakened lengths in an area where an expansion area is desired. In one embodiment, casing 12 is not a standpipe. In one embodiment, anchor/pile 10 is installed to provide increased load-carrying capacity for a structure to be installed above it than can otherwise be provided by simply relying on the support provided by existing soil. In one embodiment, anchor/pile 10 is provided to provide an anchoring support for a load that tends to pull. In one embodiment, casing 12 is not expanded to seal against ground water and expanding casing 12 does not have the effect of sealing it against ground water or other fluid in the ground. In one embodiment, when expansion member 14 is activated and thus expands casing 12, casing 12 is not punctured and nothing penetrates or passes through the casing 12 nor does anything pass through openings in casing 12. In one embodiment, no openings are provided in an area of casing 12 where an expanded area is desired. Some embodiments of the present invention do not require any portion of casing 12 to be removed. Embodiments of the present invention do not require casing 12 to extend the full length of the pile. Instead, based on the ground conditions, casing 12 can target a specific portion of the borehole for expansion, so casing 12 can be left in place only in that needed portion.

Although filler material 20 can be disposed within casing 12, embodiments of the present invention do not require casing 12 to be filled with filler material after one or more expansion areas have been created. Thus, in one embodiment, a filler material is not disposed within casing 12 after one or more expansion areas are created. In one embodiment, the tip end portion of casing 12 is preferably open and not sealed or otherwise closed. In one embodiment, expansion device 14 can comprise a bladder which is filled with a pressurized fluid such that none of the compressed fluid comes into contact with an internal wall of casing 12. Thus, in one embodiment, an exterior material of expansion device 14 is what comes into contact with an internal surface of casing 12 and which thus forces casing 12 to deform. Thus, in one embodiment, expansion device 14 does not simply comprise directly pressurizing all or a portion of casing 12 with pressurized fluid disposed in direct contact with casing 12. In one embodiment, anchor/pile 10 achieves greater capacity over an anchor of the same size that is not expanded because of increased soil confining pressure against the outer pipe walls along the surface of casing 12, thus providing greater friction resistance, and not because of a coupling structure formed between the bulge of enlarged portion 18 and the soil. Accordingly, the increased confining pressure that provides the improved performance of anchor/pile 10 comes from the soil exerting a force that is at a right angle with respect to a primary length of casing 12. At great depths, a small increase in the perimeter of the anchor and/or pile is needed to develop a very large increase in the soil confining pressure against the pipe (the capacity increase can be considerably large even though the "bulging" may be minimal).

INDUSTRIAL APPLICABILITY

The invention is further illustrated by the following non-limiting examples.

Example 1

Figure 19:
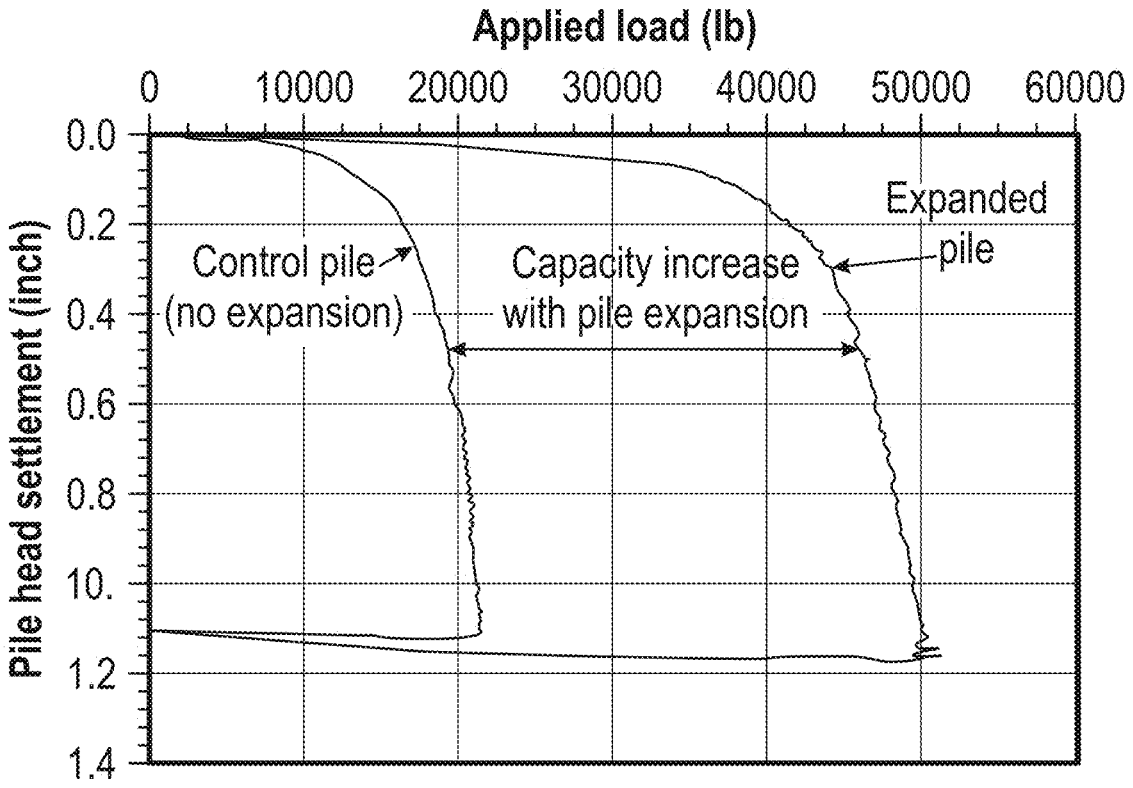
FIG. 19 is a graph that illustrates results of static load tests, corresponding to load carrying capacity of a laterally expanded capacity-enhanced pile (LECE-P), with an 48-inch long expanded portion in the lower half of the pile, and a conventional pile in medium dense sand, both piles having an embedded length in the ground of 9.5 feet, total length of 10 feet and diameter of 6.625 inches, and the base supported on a block of expanded polystyrene (EPS) foam to minimize the end-bearing resistance of these piles.

Multiple mid-scale tests on instrumented 6.625-inch (0.168-meter) outside diameter, 0.134-inch (3.4-milimeter)

wall thickness, 10-ft (3.048-meter) long T-304 stainless-steel Schedule 10 pipe piles, each with a 48-inch (1.219-meter) long single expanded portion in the lower half of the pile (corresponding to an increase in diameter of nearly 1 inch or 25.4 millimeters ("mm"), installed in medium dense dry sand, have shown a 2.2-2.6 times capacity increase in axial compression over a conventional (unexpanded) steel pipe pile of the same dimensions (FIG. 19). The test results confirmed that most of the load-carrying capacity increase was from friction resistance caused by the enlargement of the diameter of a portion of the pile. The tests confirmed that the axial capacity was maintained or slightly increased a month after the casing expansion. The capacity increase was mostly due to an increase in friction (shaft) resistance. The magnitude of the increase in lateral soil stress in the radial direction caused by the enlargement of the casing diameter, measured in these tests using soil pressure transducers placed in the soil at the same elevation as the expanded portion, was approximately up to 23 times the vertical effective stress at the same depth at a distance of 2.5 times the initial casing diameter (prior to expansion) from the casing center.

The preceding examples can be repeated with similar success by substituting the generically or specifically described components and/or operating conditions of embodiments of the present invention for those used in the preceding examples.

The terms, "a", "an", "the", and "said" mean "one or more" unless context explicitly dictates otherwise. Note that in the specification and claims, "about", "approximately", and/or "substantially" means within twenty percent (20%) of the amount, value, or condition given.

Embodiments of the present invention can include every combination of features that are disclosed herein independently from each other. Although the invention has been described in detail with particular reference to the disclosed embodiments, other embodiments can achieve the same results. Variations and modifications of the present invention will be obvious to those skilled in the art and this application is intended to cover, in the appended claims, all such modifications and equivalents. The entire disclosures of all references, applications, patents, and publications cited above are hereby incorporated by reference. Unless specifically stated as being "essential" above, none of the various components or the interrelationship thereof are essential to the operation of the invention. Rather, desirable results can be achieved by substituting various components and/or reconfiguring their relationships with one another.

What is claimed is:

1. A method for providing an anchor and/or a pile comprising:

disposing an expansion member within a casing;

activating the expansion member such that the expansion member presses radially against an internal surface of the casing with sufficient force symmetrically to induce plastic deformation of at least a first portion of the casing radially, thereby creating at least a first enlarged area of the casing which is enlarged radially around a perimeter of the casing;

removing an upper portion of the casing and leaving a lower portion of the casing; and using at least the lower casing as the anchor and/or the pile.

2. The method of claim 1 wherein using at least the lower casing as the anchor and/or the pile comprises using the lower casing as the anchor to resist a pulling force of a structure.

3. The method of claim 1 wherein using at least the lower casing as the anchor and/or the pile comprises using the lower casing as the pile to support a load created by a weight of a structure and/or a lateral load provided by the structure.

4. The method of claim 1 further comprising filling at least a portion of the casing with a filling material.

5. The method of claim 4 wherein filling at least a portion of the casing with a filling material comprises filling a least a portion of the casing with a grout.

6. The method of claim 1 further comprising disposing an anchor rod within the casing.

7. The method of claim 1 further comprising coupling at least one attachment connection to the casing.

8. The method of claim 1 further comprising after inducing plastic deformation of at least a first expanded portion of the casing:

allowing the expansion member to contract;

moving the expansion member to another location within the casing; and activating the expansion member such that the expansion member presses against an internal surface of the casing with sufficient force to induce plastic deformation of at least a second portion of the casing, thereby creating a second enlarged area of the casing.

9. The method of claim 1 wherein disposing an expansion member within the casing comprises disposing a hydraulically expandable member within the casing.

10. The method of claim 9 wherein disposing a hydraulically expandable member within the casing comprises disposing a hydraulically expandable bladder within the casing.

11. The method of claim 1 wherein the method does not comprise providing slits or other openings in a location of the first portion of the casing.

12. The method of claim 1 further comprising disposing the casing at least partially within a ground.

13. The method of claim 1 wherein the anchor and/or the pile is an existing anchor or pile and wherein disposing an expansion member within a casing comprises lowering the expansion member into a hollow portion of the existing pile or the existing anchor.

14. A method for providing an anchor and/or a pile from an existing anchor and/or an existing pile comprising:

disposing an expansion member within a casing by lowering the expansion member into a hollow portion of the existing pile or the existing anchor;

activating the expansion member such that the expansion member presses radially against an internal surface of the casing with sufficient force symmetrically to induce plastic deformation of at least a first portion of the casing radially, thereby creating at least a first enlarged area of the casing which is enlarged radially around a perimeter of the casing; and using at least the casing as the anchor and/or the pile.

15. The method of claim 14 wherein using at least the casing as the anchor and/or the pile comprises using the casing as the anchor to resist a pulling force of a structure.

16. The method of claim 14 wherein using at least the casing as the anchor and/or the pile comprises using the casing as the pile to support a load created by a weight of a structure and/or a lateral load provided by the structure.

17. The method of claim 14 further comprising filling at least a portion of the casing with a filling material.

18. The method of claim 17 wherein filling at least a portion of the casing with a filling material comprises filling a least a portion of the casing with a grout.

19. The method of claim 14 further comprising disposing a top plate or pile cap on an upper end portion of the casing.

20. The method of claim 14 further comprising disposing an anchor rod within the casing.

21. The method of claim 14 further comprising coupling at least one attachment connection to the casing.

22. The method of claim 14 further comprising after inducing plastic deformation of at least a first expanded portion of the casing:

allowing the expansion member to contract;

moving the expansion member to another location within the casing; and activating the expansion member such that the expansion member presses against an internal surface of the casing with sufficient force to induce plastic deformation of at least a second portion of the casing, thereby creating a second enlarged area of the casing.

23. The method of claim 14 wherein disposing an expansion member within the casing comprises disposing a hydraulically expandable member within the casing.

24. The method of claim 23 wherein disposing a hydraulically expandable member within the casing comprises disposing a hydraulically expandable bladder within the casing.

25. The method of claim 14 wherein the method does not comprise providing slits or other openings in a location of the first portion of the casing.

26. The method of claim 14 further comprising disposing the casing at least partially within a ground.

* * * * *